US008870148B2

(12) United States Patent
Hickman

(10) Patent No.: US 8,870,148 B2
(45) Date of Patent: Oct. 28, 2014

(54) ARTIST'S EASEL ATTACHABLE TO A DOOR

(71) Applicant: Robert Wayne Hickman, Lexington, SC (US)

(72) Inventor: Robert Wayne Hickman, Lexington, SC (US)

( * ) Notice: Subject to any disclaimer, the term of this patent is extended or adjusted under 35 U.S.C. 154(b) by 20 days.

(21) Appl. No.: 13/802,783

(22) Filed: Mar. 14, 2013

(65) Prior Publication Data

US 2014/0263922 A1 Sep. 18, 2014

(51) Int. Cl.
*A47B 97/04* (2006.01)

(52) U.S. Cl.
CPC ..... *A47B 97/04* (2013.01)
USPC ..... 248/447.2; 211/119.004; 248/449; 248/457

(58) Field of Classification Search
USPC ..... 248/689, 693, 441.1, 447.1, 447.2, 449, 248/457, 494, 201, 213.1; 211/102, 211/119.002, 119.004
See application file for complete search history.

(56) References Cited

U.S. PATENT DOCUMENTS

| | | | | | |
|---|---|---|---|---|---|
| 2,235,367 | A * | 3/1941 | Heausler | 248/445 |
| 2,925,916 | A * | 2/1960 | Pollock | 211/119.004 |
| 3,095,834 | A * | 7/1963 | Killen | 108/15 |
| 3,231,230 | A * | 1/1966 | Mueller | 248/449 |
| 4,239,170 | A * | 12/1980 | Planebo | 248/447.1 |
| 4,258,893 | A * | 3/1981 | Tolley | 248/447.1 |
| 4,846,430 | A * | 7/1989 | Ke | 248/215 |
| 5,950,979 | A * | 9/1999 | Mira | 248/460 |
| 6,471,174 | B2 * | 10/2002 | Turner | 248/449 |
| 6,601,805 | B1 * | 8/2003 | Kapp | 248/171 |
| 7,178,769 | B2 * | 2/2007 | Magnusson et al. | 248/201 |
| 7,934,958 | B2 * | 5/2011 | Kendall et al. | 439/628 |
| 2010/0270246 | A1 * | 10/2010 | Rodriguez | 211/34 |

* cited by examiner

*Primary Examiner* — Bradley Duckworth
(74) *Attorney, Agent, or Firm* — Jonathan Kidney

(57) ABSTRACT

A space saving, door-mountable artist's easel with a framework adapted to receive and hold an artist's canvas, art panel, clipboard, or some other item that would normally be affixed to an easel with a mounting bracket attached to the frame so the entire device may be hung on a door. The easel can be used while mounted to the door it is stored on. In one example, a front pivoting frame enables the mounted piece to be extended outward from a back stationary frame. A height adjustment mechanism allows the mounted piece to be raised or lowered to a desired position, enabling the artist to stand or sit. The compactness of the easel enables an art piece being worked on to be left mounted to the easel for drying or viewing, and the door can still be opened and closed normally with the easel mounted to it.

20 Claims, 8 Drawing Sheets

ARTIST'S EASEL ATTACHABLE TO A DOOR

FIELD OF INVENTION

The invention relates to artist's easels. More particularly, this invention relates to an artist's easel that can be easily mounted to either side of a door.

BACKGROUND

Economy artist's easels typically are composed of a three-legged wooden framework, of much the same format as the traditional blackboard easel, that "stand" on the floor via the framework's legs. Higher quality easels typically have a wooden frame with pinned segments that can be moved so that the frame will rest on the floor. For an easel to be stored, it must be folded up and moved off the floor space. Once it has been folded up, the easel is not stable and not in a state that it can be used in an effective manner.

All floor easels have one feature in common: they require floor space while being used, and sometimes while being stored. If a person does not have enough space to leave the easel set up while not being used, he/she must typically remove the artwork from the easel, fold the easel up, and put it away for storage, as well as find a safe place to store the art panel until ready to work on it again. Having to set-up and take-down the easel is inconvenient, especially in a small studio or work area where floor space is at a premium.

In view of the above, there has been a long standing need in the artist's community for a more "space-friendly" easel. Accordingly, details of a door-mountable artist's easel are elucidated below that obviates many of the above difficulties.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The foregoing needs are met, to a great extent, by the present disclosure, wherein in one aspect of an embodiment, a door-mountable artist's easel is provided, comprising: an upper door mountable bracket with a door mounting portion and a fixture portion, the door mounting portion shaped to fit around a top edge of a door; a workpiece attachment fixture, comprising: a vertically arranged, substantially longitudinal support member with a door-side face, an artist-side face, a top portion and a bottom portion, wherein the top portion is attached to the fixture portion of the bracket; a plurality of workpiece securing members, bounding a top and lower portion of a workpiece, and slidably attached to the artist-side face of the workpiece attachment fixture, wherein at least one of the plurality of workpiece securing members is adjustable in height along the longitudinal support member; and at least one tightening fixture, fixing a position of at least one of the plurality of workpiece securing members that is adjustable in height; and an adjustable length bracket assembly, comprising: a lower door mountable bracket with a lower door mounting portion and an upper fixture portion, the lower door mounting portion being shaped to fit around a bottom edge of a door; and an adjustable length member attached at one end to the upper fixture portion and at an other to the lower door mounting portion.

In another aspect of an embodiment, a door-mountable artist's easel is provided, comprising: an upper door mountable bracket with a door mounting portion and a fixture portion, the door mounting portion shaped to fit around a top edge of a door; and a workpiece attachment fixture, comprising: a back frame, a top portion of the back frame being attached to the fixture portion of the bracket; a vertically arranged, substantially longitudinal workpiece support member with an artist-side face, attached to the back frame; a plurality of workpiece securing members, bounding a top and lower portion of a workpiece, and slidably attached to the artist-side face of the workpiece support member, wherein at least one of the plurality of workpiece securing members is adjustable in height along the workpiece support member; and at least one tightening fixture, fixing a position of at least one of the plurality of workpiece securing members that is adjustable in height.

In yet another aspect of an embodiment, a door-mountable artist's easel is provided, comprising: an upper door mountable bracket with a door mounting portion and a frame attachment portion, the door mounting portion shaped to fit around a top edge of a door; a back frame with a top portion and a bottom portion, a top portion of the back frame being attached to the frame attachment portion of the bracket; a front frame with a top portion and a bottom portion, a top portion of the front frame being pivotally attached to another top portion of the back frame; a rigidity guide pivotally attached to the back frame and pivotally attached to the front frame; a vertically arranged, substantially longitudinal workpiece support member with a door-side face and an artist-side face, the door-side face being attached to the front frame; a plurality of workpiece securing members, bounding a top and lower portion of a workpiece, and slidably attached to the artist-side face of the workpiece support member, wherein at least one of the plurality of workpiece securing members is adjustable in height along the workpiece support member; and at least one tightening fixture, fixing a position of at least one of the plurality of workpiece securing members that is adjustable in height.

DETAILED DESCRIPTION

As described in the following FIGS., various embodiments of an artist's easel are shown comprising a framework adapted to receive and hold an artist's canvas, art panel, clipboard, or some other item that would normally be affixed to an easel; and is structured so as to allow a mounting bracket(s) to be attached to the frame so the entire device may be hung on a door in a room, for example, in a home, workplace, or school environment.

Because the easel can be mounted to a door, no floor space is needed to store it. In some embodiments, the easel has the capability to be used while in a mounted state. Therefore, the user may simply "store" the easel upon a door or use it while mounted to the door. In some scenarios, the user may move the easel from one door to another door having more desirable lighting or utility. Accordingly, individuals, who are very space limited such as in a small apartment or dormitory room, will be able to have an easel to work on without giving up any needed floor space.

The art piece being worked on can be left mounted to the easel for drying or viewing, and the door can still be opened and closed normally with the easel mounted to it.

While providing space saving, the easel's stability is actually enhanced by being mounted to a door, understanding that a door is firmly fixed to the walls of a room via its hinges. Therefore, the easel, and thus the mounted artwork, cannot be "accidentally" tipped over as is often experienced in conventional easels, thus preventing damage to the art as well as the easel.

Additionally, in some embodiments, the user can set the working angle of the artwork from a vertical (e.g., folded) up position to a desired viewing/working angle, for example, up to 15 degrees off vertical. This ability to adjust the angle makes the easel desirable for artists of all kinds, from pastel users to acrylics and oil users. Further, in embodiments with adjustable positioning, the art being worked on can be positioned so that the user can be seated or standing.

Figure 1:
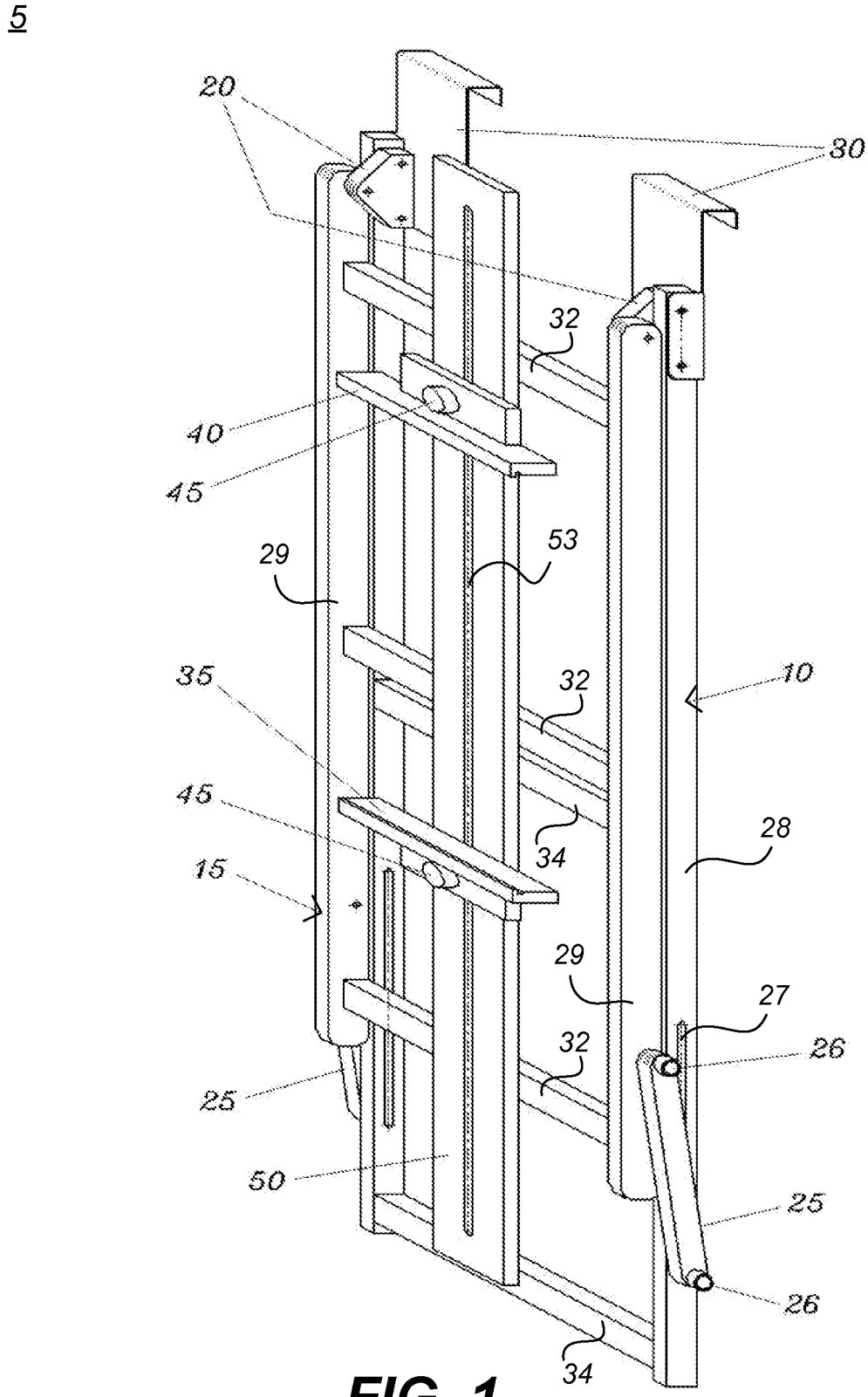
FIG. 1 is an illustration of a perspective view of an easel in a "closed" state.
Figure 2:
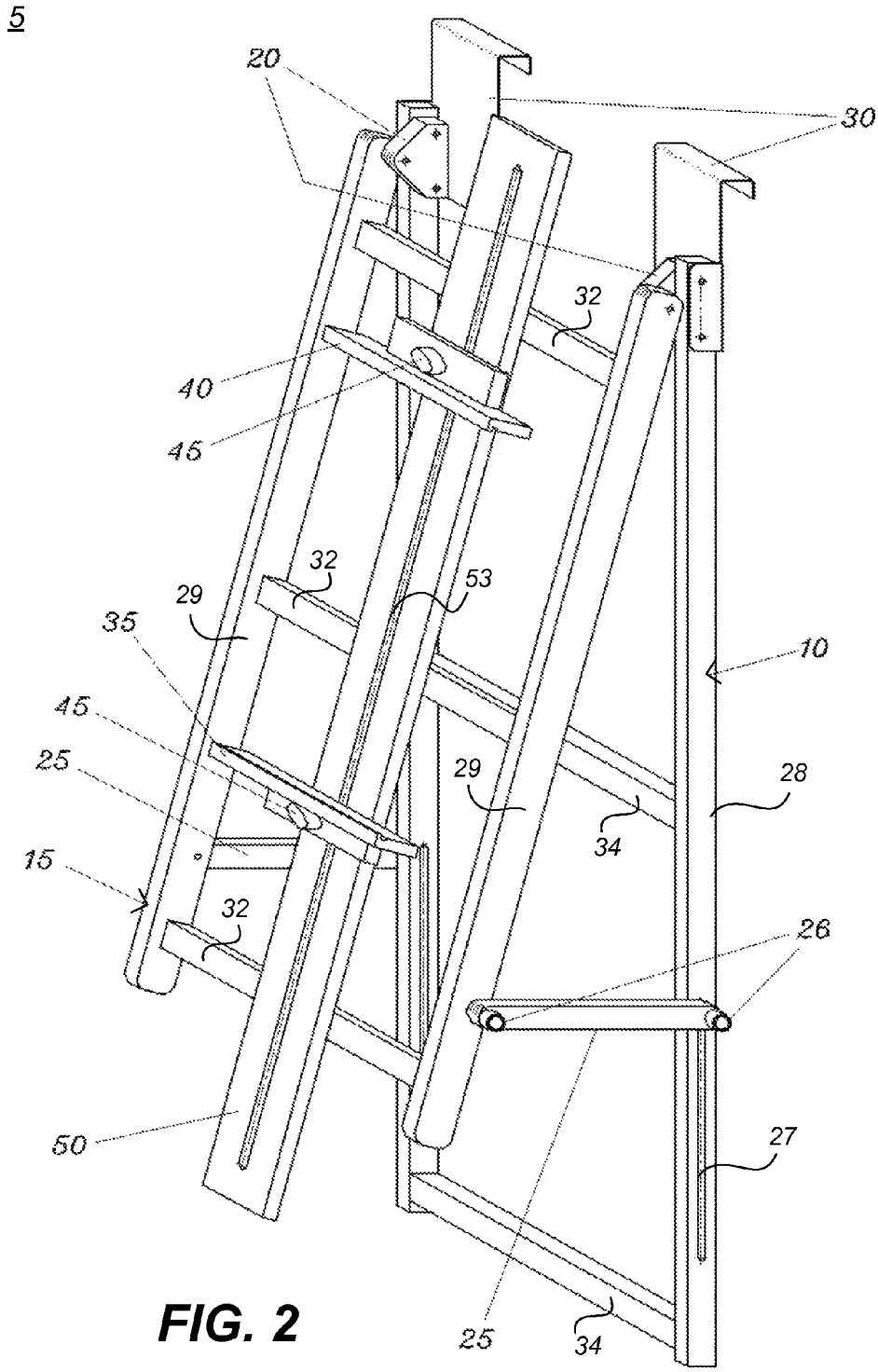
FIG. 2 is an illustration of a perspective view of the easel of FIG. 1 in its maximum "open" state.

FIG. 1 is an illustration of a perspective view of a door-hung adjustable easel 5 in a retracted or folded state and FIG. 2 is an illustration of the easel 5 in an extended or open state. The easel 5 is used for supporting an artist's canvas or panel (not shown), as broadly defined, in a generally upright, front-facing positioning, and is understood to be mounted to a door (not shown).

Referring to FIG. 1 and FIG. 2, the easel 5 is formed of a door mounting rear frame 10 and an art work mounting front frame 15, connected by bracket(s) 20 at an upper end of rear frame 10 and front frame 15. Rear frame 10 is formed from vertical member(s) 29 joined by one or more supporting members 34, providing rigidity to rear frame 10. Front frame 15 is formed from vertical member(s) 28 joined by one or more supporting members 32, providing rigidity or rear frame 10 and also a platform for attachment of front frame's 15 vertical fixture base 50, as further detailed below.

By use of "skeletal" rear and front frames 10, 15 a significant weight savings can be achieved versus using a solid frame. However, in some embodiments, use of different materials or lighter/stronger materials may obviate the need for a skeletal framing approach and therefore, while the FIGS. illustrate a frame-like "structure," other structures, whether frame-like or not may be utilized without departing from the spirit and scope of this disclosure. For example, rear frame 10 may be a solid structure, as well as front frame 15, thus obviating the need or utility of supporting members 32, 34. Also, if supporting members(s) 32, 34 are used, they may be diagonally positioned or arched or of any configuration or shape that provides support to vertical members 28, 29.

Continuing, bracket(s) 20 is bolted or fastened in a secure manner to rear frame 10 and is joined to front frame 15, typically by a pivot enabling bolt/pin (not shown). Bracket(s) 20 may use a hinge or any other similarly functioning mechanism to secure back frame 10 to front frame 15. Pin/hinge provides the ability for the top portion of front frame 15 to pivot, allowing the bottom portion of front frame 15 to swing "outward" away from a door or back.

Side link(s) 25 are attached to the bottoms of back frame 10 and front frame 15 to provide support and stability for front frame 15, when in an extended position. One end of side link(s) 25 is "pinned" by a rotatable bolt or link (not shown) to vertical member(s) 29 of front frame 15 and the other end of side link(s) 25 is connected to vertical member(s) 28 of frame 10 by a bolt/pin (not shown) that may go through a slot 27 in vertical member(s) 28. The travel of side link(s) 25 determines how far front frame 15 is able to be extended out from back frame 10. Therefore, depending on the length of side link(s) 25 (and length of groove 27), various degrees of extension of front frame 15 from back frame 10 can be realized.

It is readily apparent that one of ordinary skill may make changes or modifications to the side link(s) 25 and groove 27 arrangement without departing from the spirit and scope of this disclosure. For example, groove 27 may be disposed on the front member 29 of front frame 10, reversing the arrangement seen. Moreover, while a pin/slot mechanism is used to control movement of side link(s) 25, other forms of front frame 15 extension control may be used. For example, a arm that "locks" when extended may be used instead of side link(s) 25, or a springing mechanism. Accordingly, it is expressly understood that various modifications that are within the purview of one of ordinary skill in the art are within the scope of this disclosure.

To provide the ability to fix an angle of extension, knob(s) 26, or equivalent for tightening, are disposed on one or more of the bolts/pins that go through side link(s) 25 so that a position of the easel 5 can be locked, providing stability and stiffness to the font frame 15 when extended.

The bracket(s) 30 that is attached to the top of rear frame 10 is shaped so that it can be placed over the top edge of a door (not shown). The size of bracket(s) 30 can be fixed or adjustable, depending on design preference, to enable bracket(s) 30 to "hang" onto the top of a door. It is understood that in a commercial embodiment, bracket(s) 30 may be sized to accommodate the great majority of standard door widths. If smaller door thicknesses are present, small shims can be inserted between the door and the bracket(s) 30 to provide a good fit. If the door thickness is too great, then bracket(s) 30 can easily be made to meet the need. In some embodiments, bracket(s) 30 may be detachable from front frame 15 and back frame 10, allowing a user to replace bracket(s) 30 with another bracket(s) that is sized for the thickness of the door of interest.

In other embodiments, bracket(s) 30 may be attached to supporting member 32 of back frame 10, understanding that in the embodiments shown, for example, in FIGS. 1-2, bracket(s) 30 may need to be lengthened to attach to supporting members 32. Alternatively, one of supporting members 32 may be positioned "higher" on back frame 10 to allow bracket(s) 30 to be easily attached. It is understood, given the numerous different ways that bracket(s) 30 may be attached to back frame 10, changes, modifications, variations to the "attachment" arrangement are understood to be within the scope of one of ordinary skill in the art and are considered to be within the purview of this disclosure. As one non-limiting example, bracket(s) 30 may be adjustable in length, using perhaps an adjustable tension providing strap to form the connection with back frame 10.

Easel 5 in a closed or retracted state (an angle of nearly zero degrees between the rear frame 10 and the front frame 15) in FIG. 1. This position will likely be the position that easel 5 will be stored in while not being used. However, it is understood that some artists such as users of pastel, for example, will want to use the easel 5 in this position.

In addition to side member(s) 29, front frame 15 will have adjustable height bottom artwork fixture 35 and top artwork fixture 40, which slide via rear locking bolts/pins (not shown) traveling in slotted hole 53 in vertical fixture base 50. Vertical fixture base 50 is attached to supporting member(s) 32. Bottom and top artwork fixtures 35,40 are secured or tightened to vertical fixture base 50 via tightening knob(s) 45 connected to rear locking bolts/pins.

In this arrangement, bottom artwork fixture 35 and top artwork fixture 40 can be adjusted to hold an artist's canvas or panel at a suitable working height. Each of bottom and top artwork fixtures 35, 40 are positioned by loosening knob(s) 45 to release the tension on the locking bolts/pins, moving the respective fixture to the desired height, and then tightening the knob(s) 45. Vertical fixture base 50 can be rigidly affixed to front frame 15 so that the weight of the artist's canvas or panel is sufficiently distributed to the easel 5. It should be understood that in some embodiments, bottom artwork fixture 35 may be stationary, the artwork being placed on stationary bottom artwork fixture 35 and top artwork fixture 40 being lowered to constrain the artwork from movement. Conversely, in some embodiments, it may be designed to where to artwork fixture 40 may be fixed and bottom artwork fixture 35 may be adjustable in height.

While the mechanism for securing an artist's canvas/panel is illustrated as being accomplished via sliding fixtures 35, 40 controlled by slotted hole 53, and tightened by knob(s) 45, other commonly used mechanisms for securing a canvas/panel or adjusting its height and/or location on front frame 15 are understood to be within the purview of one of ordinary skill in the art and are incorporated herein. For example, a pulley system connecting bottom and top artwork fixtures 35, 40 may be used. Or springs pushing against bottom and top artwork fixtures 35, 40 to put pressure on an inserted canvas/panel. Therefore, while the FIGS. show one possible mechanism for securing a canvas/panel and adjusting it height, other mechanisms maybe utilized without departing from the spirit and scope of this disclosure.

FIG. 2 is an illustration of the easel 5 of FIG. 1 with front frame 15 in an extended position. In some embodiments, front frame 15 may be extended from several degrees up to 15 degrees and more, depending on implementation preference. The angle can easily be increased even more by using a longer side link(s) 25 and cutting longer slotted hole 27 in the vertical member(s) 28 of rear frame 10 to allow for the greater travel of the rear locking bolts/pins.

Front frame 15 can be positioned by the user to hold the artist's canvas/panel at a desired working height by appropriately moving bottom artwork fixture 35 and top artwork fixture 40. As stated above, each top and bottom fixture 35, 40 can be positioned by loosening knob(s) 45 to release the tension on the respective locking bolt, moving the respective fixture to the desired height, and then tightening knob(s) 45.

Figure 3A:
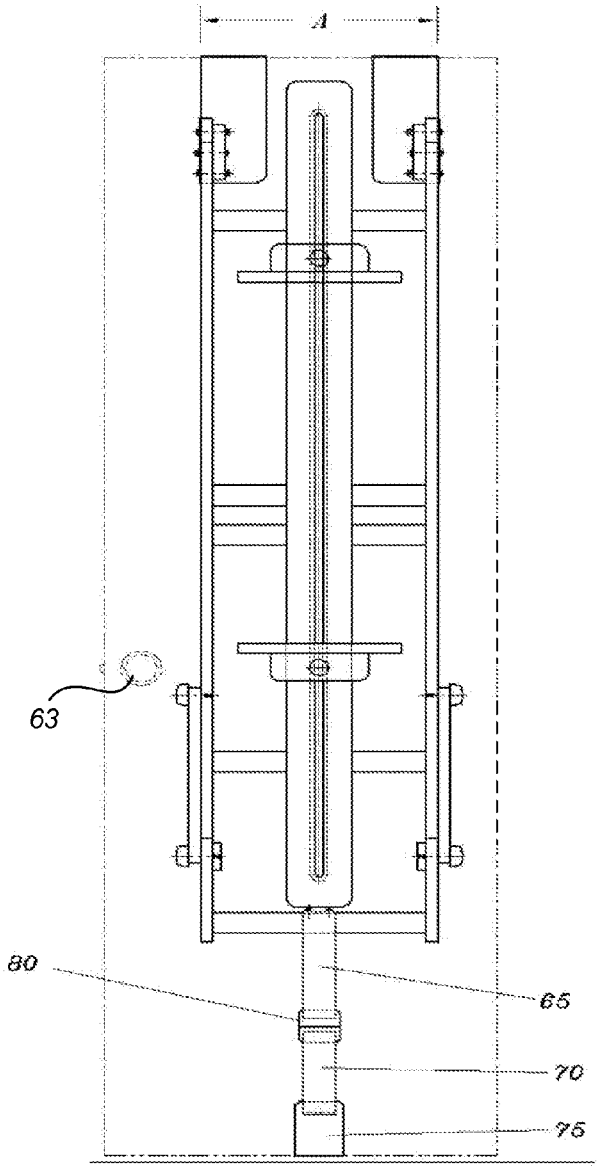
FIGS. 3A-B are illustrations of a front view and side view, respectively of the easel of FIG. 1.
Figure 3B:
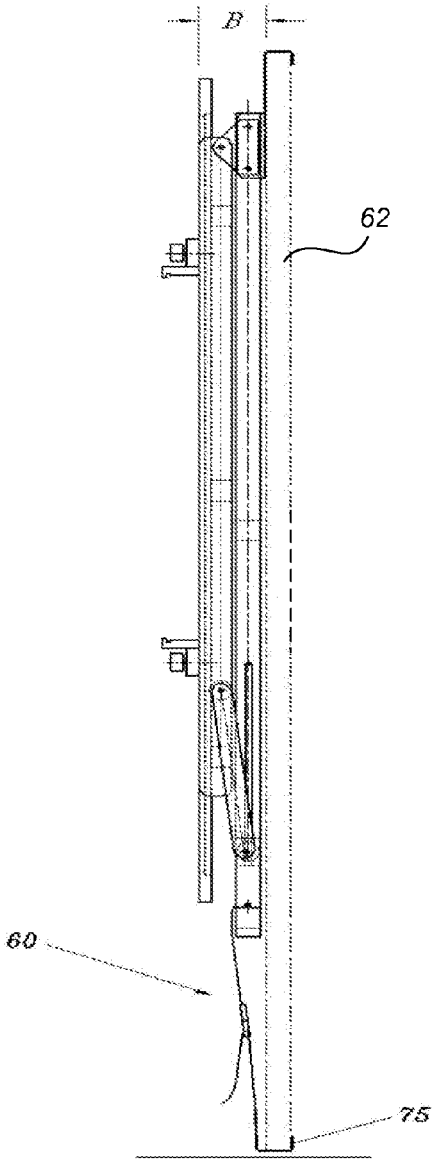

FIGS. 3A-B depict front and side views, respectively, of the easel 5 shown in FIG. 1 as mounted to a door 62. The compact form of easel 5, when in a "closed" state permits normal use of door 62. The easel 5 can be of sufficiently narrow width "A" to allow ample space to grasp the door knob 63 in order to open and close the door 62. In various embodiments, the thickness of front frame and rear frames 15, 20 (FIGS. 1-2) can be such that artist's canvas/panel will not come in contact with the door knob 63 when the easel 5 is in the retracted condition (as seen in FIG. 1). That is, the combined thickness of front and rear frames "B" (Seen in FIG. 3B) can be greater than the length of the door knob 63.

FIGS. 3A-B also show an optional stabilizing strap assembly 60 that will help hold the easel 5 stationary if the user deems it necessary. This stabilizing strap assembly 60 can consist of a short piece of flexible nylon strap 65 that is securely mounted to the lower supporting member 34 of front frame 15 and another piece of flexible nylon strap 70 affixed to a lower door bracket 75 that is configured to fit securely under the lower edge of the door 62. The nylon straps 65 and 70 can be joined and separated by a standard release snap 80. By pulling on the loose end of the nylon strap 70, the stabilizing strap assembly 60 is tightened and pulls down on the entire easel 5. This will tend to make rear frame 10 come in contact with the face of the door 62 and will keep it from moving. The stabilizing strap assembly 60 can be loosened by pinching the sides of the release snap 80, thus allowing the easel 5 to be adjusted from side to side or removed from the door 5.

Figure 4:
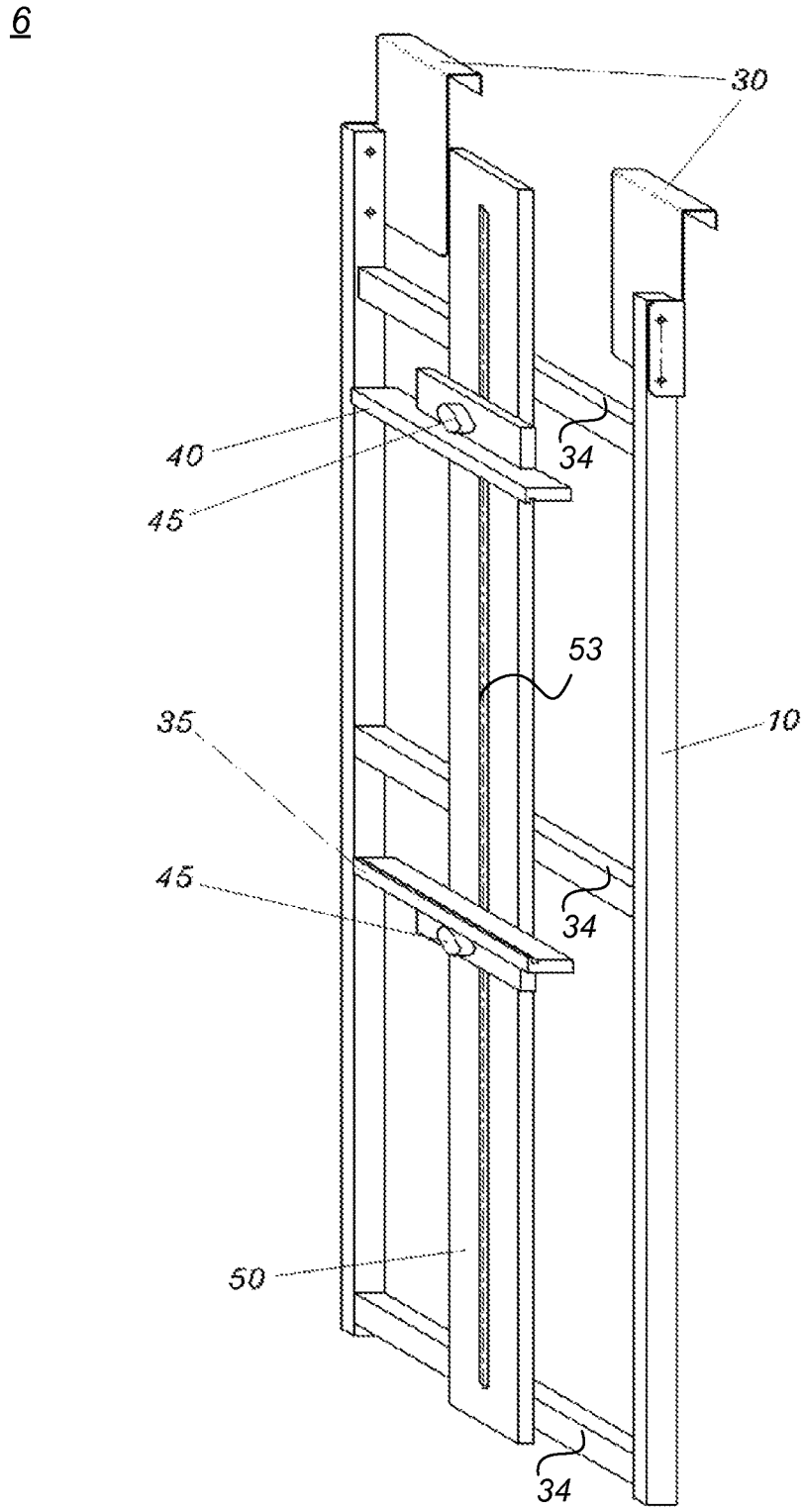
FIG. 4 is an illustration of another easel.

FIG. 4 is an illustration of another door-hung height adjustable easel 6 without a front frame. The vertical fixture base 50 is mounted to supporting member(s) of rear frame 10 rather to an extendable front frame 15, as described in FIGS. 1-2. Therefore, an attached canvas/panel will be constrained to a vertical, front-facing positioning. Adjustable height bottom artwork fixture 35 and top artwork fixture 40 are also shown with slotted hole 53 in vertical fixture base 50, as well as tightening knob(s) 45 connected to rear locking bolts/pins. Aspects of the operation of this embodiment are similar to those described above, with the exception that a front frame is missing and therefore are understood to be self-explanatory.

The entire easel 6 is hung from a door with bracket(s) 30. The bracket(s) 30, are coupled to the rear frame 10, and configured in a manner to allow placement over the top edge of a door. The width and weight of the rear frame 10 gives some stability to the overall assembly, however an optional stabilizing strap assembly 60 (as shown in FIG. 3) may still be necessary depending on the user's needs and preferences. Some artists may prefer the easel assembly in this vertical configuration. It is a much simpler and less expensive device than the easel 5 described in FIGS. 1-2. If vertical fixture base 50 (and attendant travel mechanisms) is designed to be of sufficient height, the artist's canvas or panel can be raised or lowered to be used in a standing or seated position.

Figure 5:
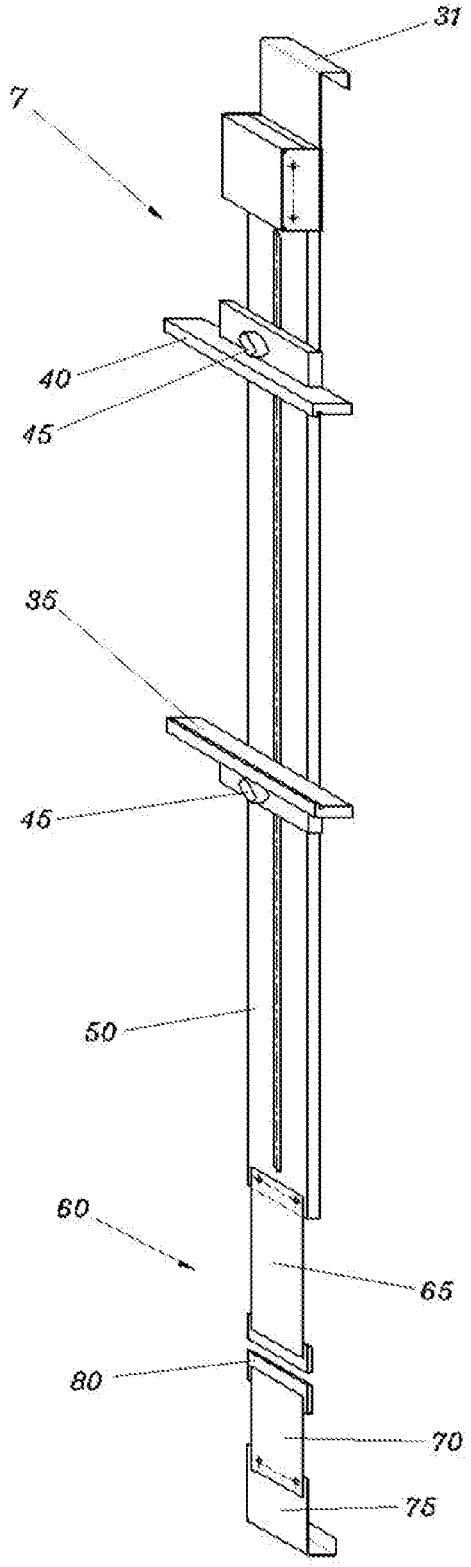
FIG. 5. is an illustration of another easel.

FIG. 5 is another door-hung adjustable easel 7 without front or back frames. Easel 7 is a simplification of the earlier-described easels 5, 6. Like FIG. 4's easel 6, an artist's canvas or panel that is attached to this easel 7 will be constrained to a vertical, front-facing positioning. Top-mounted hanging bracket 31 is attached to vertical fixture base 50, having adjustable height bottom artwork fixture 35 and top artwork fixture 40, slotted hole 53, as well as tightening knob(s) 45 connected to rear locking bolts/pins. However, rather than vertical fixture base 50 being attached to any supporting member(s), the top of vertical fixture base 50 is attached to bracket 31. The bottom of vertical fixture base 50 is attached to stabilizing strap assembly 60, to add stability to this configuration. As in FIG. 5, if the vertical fixture base 50 (and attendant travel mechanisms) is designed to be of sufficient height, the artist's canvas or panel can be raised or lowered to be used in a standing or seated position. Aspects of the operation of this embodiment are similar to those described above, with the exception that a front frame is missing and therefore are understood to be self-explanatory.

The reduction of materials for this configuration and the compactness offers potential cost benefits, as compared to the easels described above. FIGS. 4-5 are provided to demonstrate that multiple schemes, methods, designs can be used to modify the designs shown in FIGS. 1-2 to arrive at a door-hangable easel. Therefore, it is understood that one of ordinary skill in the art may modify or change aspects of the easels 4, 5, 6 without departing from the spirit and scope of this disclosure. For example, FIG. 5's bracket 31 may be attached to the top of vertical fixture base 50 via a strap (similar to stabilizing strap assembly 60), or multiple straps may extend from ends of vertical fixture base 50 (similar to pants suspenders).

Figure 6:
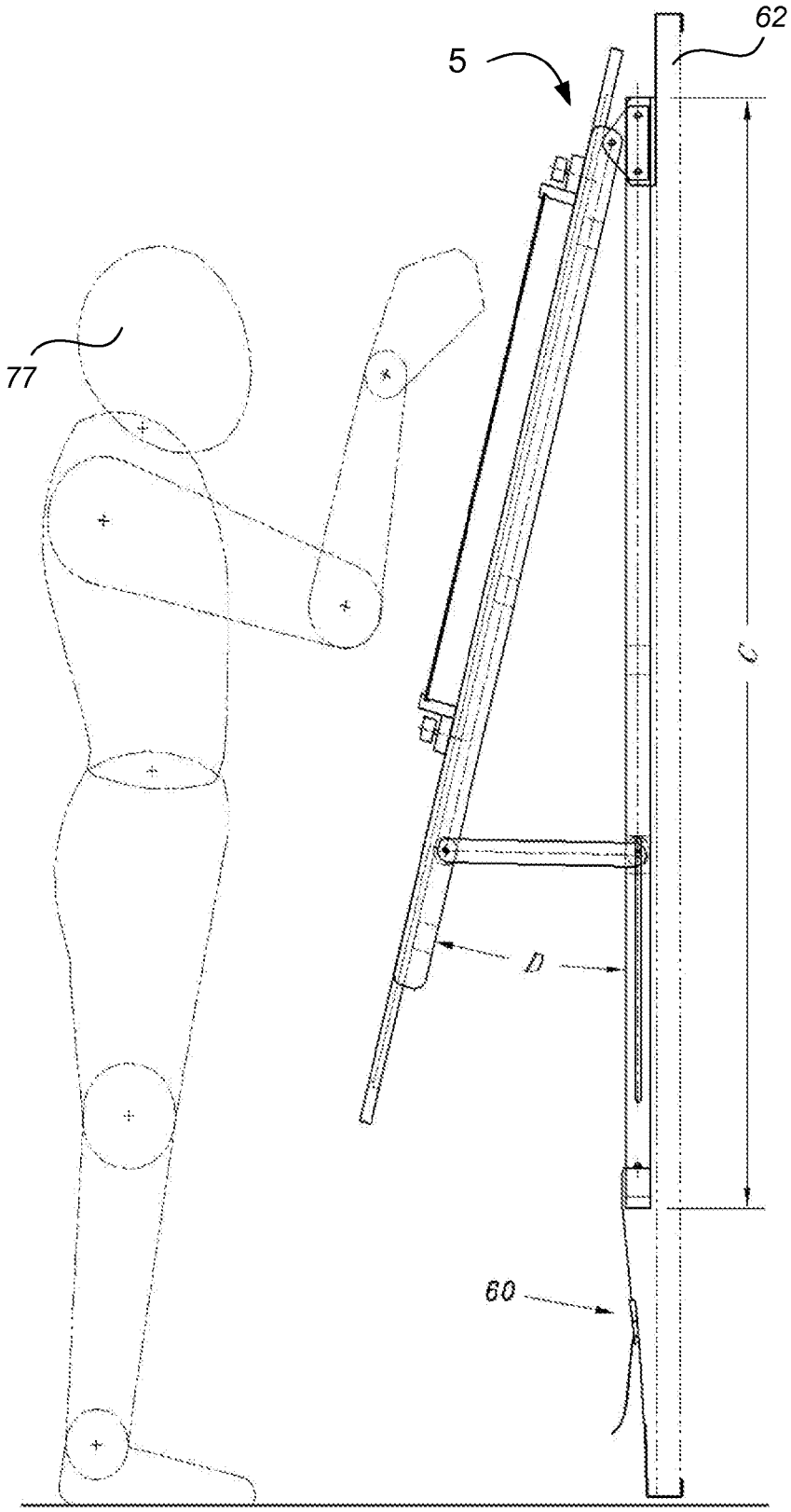
FIG. 6 is an illustration of the easel of FIG. 2 mounted to a door and being used in a standing position.

FIG. 6 is an illustration showing an easel of the form shown in FIG. 2 being used by a user 77 in a standing position, where "D" represents the maximum open/extended angle and "C" the height of the easel, "D" and "C" are design parameters that can be adjusted or tailored during manufacturing. As a point of reference, however, for a standard door height of 80 inches, one possible commercial embodiment can have a "C" of 60 inches and "D" of 15 degrees.

Figure 7:
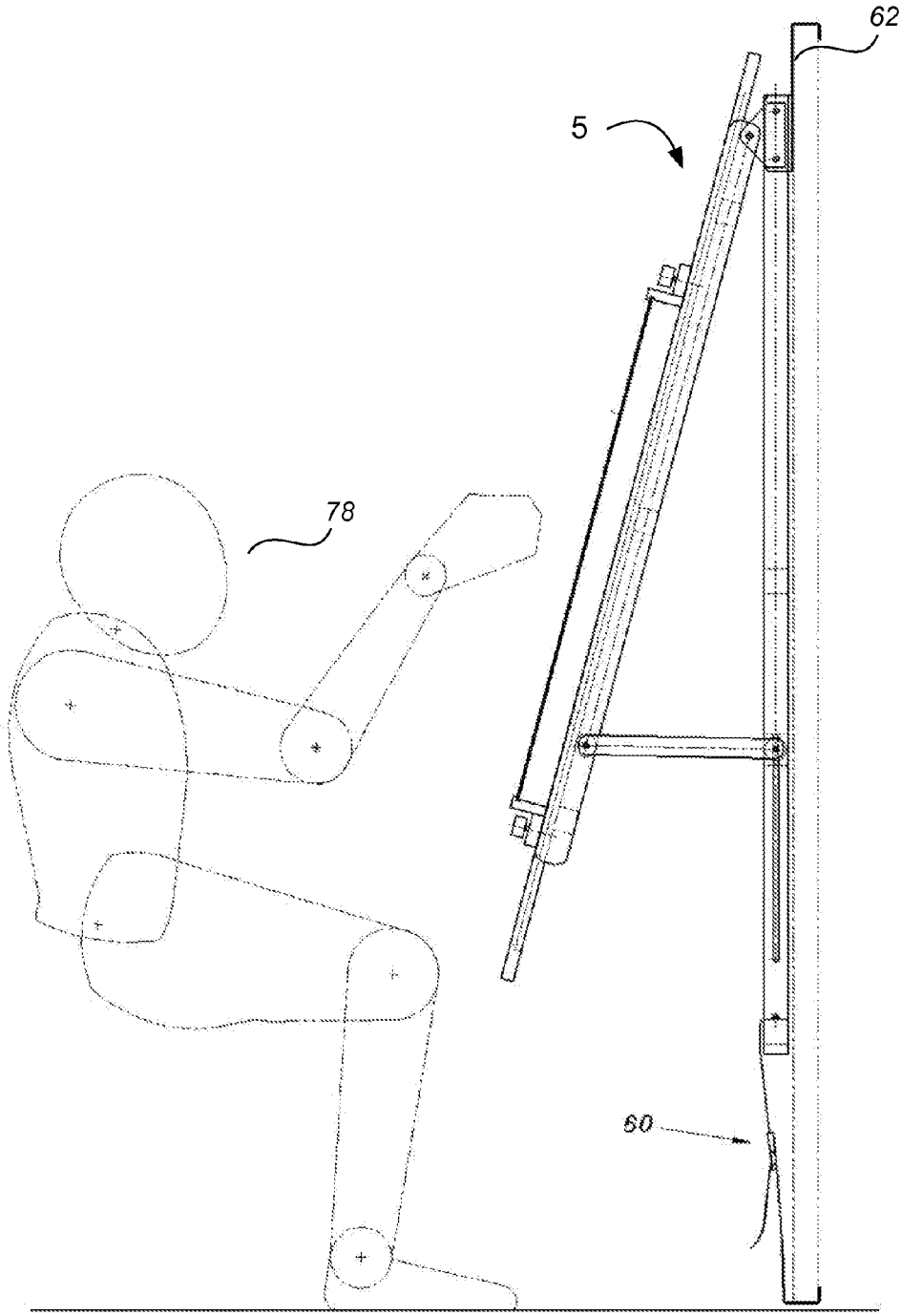
FIG. 7 is an illustration of the easel of FIG. 2 mounted to a door and being used in a sitting position.

FIG. 7 is an illustration showing a user 78 in a standing position, it is noted that user 78 can decide to stand or sit based on his "height" adjustment preference or preferred working position. Aspects of this FIG. are understood to be self-explanatory.

FIGS. 8A-8D are illustrations of various top section mounting arrangements applicable to the respective embodiments of this disclosure. Specifically, FIG. 8A. is an illustration of an alternate top section mounting arrangement analogous in many ways to the adjustable bottom stabilizing strap assemblies 60 shown in FIGS. 3A-B and 5, but configured for a top mount. A plurality of upper brackets 85 are attached to a top strap 90 (may be of flexible nylon or other similar performing material) that is connected to bottom strap 105 via respective top and bottom release connectors 95, 100, respectively. The bottom strap 105 is shown as attached to the front frame's supporting member 32. The straps may be adjusted in tension to "lock" the top portion of the easel to the door.

Figure 8A:
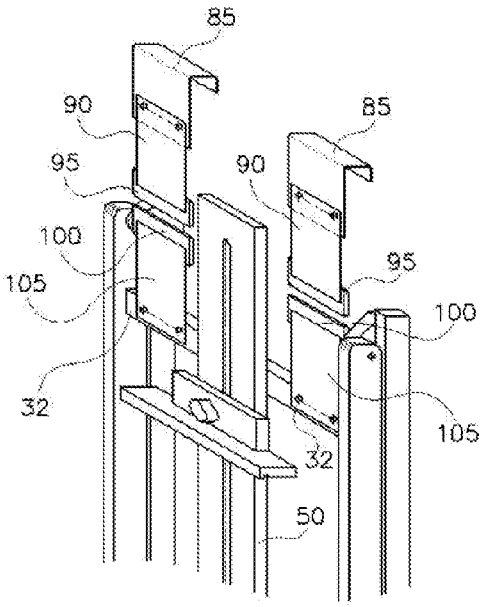
FIG. 8A. is an illustration of a top portion of an easel showing an alternate mounting arrangement.
Figure 8B:
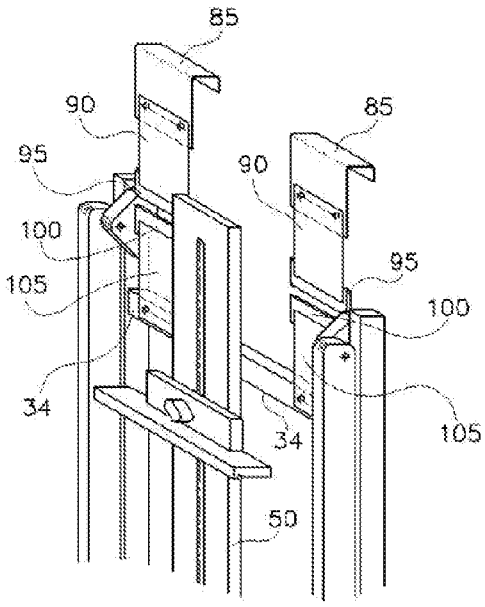
FIG. 8B. is an illustration of a top portion of another easel showing an alternate mounting arrangement.

FIG. 8B. is an illustration of an alternate top section mounting arrangement, similar to FIG. 8A, however, the bottom strap 105 is attached to the rear frame's lower supporting member 34 rather than to the front frame's supporting member 32. This configuration is simply a translation of the attachment location of FIG. 8A's straps to the rear frame's lower supporting member 34, all other elements being analogous and self-explanatory.

Figure 8C:
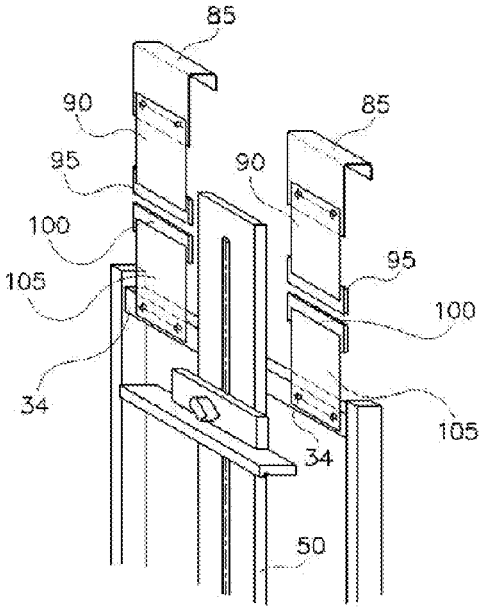
FIG. 8C. is an illustration of a top portion of another easel showing an alternate mounting arrangement.

FIG. 8C. is an illustration of an alternate top section mounting arrangement applied to the embodiment of FIG. 4. This embodiment contemplates a top-frameless attachment scenario, wherein the elements 85, 90, 95, 100, 105 are analogous to the previous FIGS. 8A-B, however, the bottom strap 105 is attached to the rear frame's lower supporting member 34.

Figure 8D:
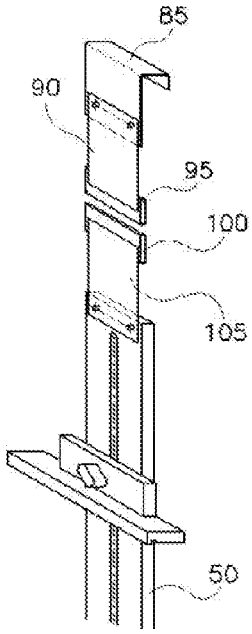
FIG. 8D. is an illustration of a top portion of another easel showing an alternate mounting arrangement.

FIG. 8D is an illustration of an alternate top section mounting arrangement applied to the vertical fixture base 50 of FIG. 5. This embodiment contemplates a frameless attachment scenario, wherein a single strap configuration is utilized. Elements 85, 90, 95, 100, 105 are analogous to the previous FIGS. 8A-C, however, the bottom strap 105 is attached to the rear frame's lower supporting member 34.

While the straps and releasable connectors attached to the straps are illustrated in the above FIGS. as being separate from the top mounting (or bottom mounting) brackets, it is expressly understood that in some embodiments, it may be of a preference to have the releasable connector directly attached to the bracket. That is, the strap may release or be tensioned via a direct coupling to the bracket rather than through an intermediary strap-to-connector-to-strap arrangement. Conversely, the releasable connector (and/or tensioning mechanism) can be directly attached to the supporting member. Thus, various modifications are within the purview of one of ordinary skill in the art.

Similarly, while the above FIGS. illustrate a releasable strap (with connector) configuration, it is understood that other mechanisms for releasing and/or tensioning may be utilized without departing from the spirit and scope of this disclosure. For example, a belt-like tensioning/connector may be utilized. Therefore, the connector arrangements shown above are simply illustrative and understood not to be limiting, as there are numerous other mechanical devices well known to one of ordinary skill in the art that may be substituted to provide a similar tensioning and/or connector-like effect.

Further, while the embodiments of FIGS. 8A-C illustrate two brackets with accompanying straps, a single bracket may be utilized, for example, as seen in FIG. 8D, as well as more than three brackets, etc.

Fixtures and add-ons can be easily added to various embodiments of the easels. Non-limiting examples being lighting, a flat table surface, storage boxes, clipboard holder, electrical outlets, etc. The versatility and utility of the easel(s) will make it desirable by amateur and professional artists, as well as the parents, who want a quality working area for their children that is easy to set-up, maintain and clean up, and that requires no additional free floor space.

It will be understood that many additional changes in the details, materials, steps and arrangement of parts, which have been herein described and illustrated to explain the nature of the invention, may be made by those skilled in the art within the principle and scope of the invention as expressed in the appended claims.

What is claimed:

1. A door-mountable artist's easel, comprising:

an upper door mountable bracket with a door mounting portion and a fixture portion, the door mounting portion shaped to fit around a top edge of a door;

a workpiece attachment fixture, comprising:

a vertically arranged, substantially longitudinal support member with a door-side face, an artist-side face, a top portion and a bottom portion, wherein the top portion is attached to the fixture portion of the bracket;

a plurality of workpiece securing members, bounding a top and lower portion of a workpiece, and slidably attached to the artist-side face of the workpiece attachment fixture, wherein at least one of the plurality of workpiece securing members is adjustable in height along the longitudinal support member; and at least one tightening fixture, fixing a position of at least one of the plurality of workpiece securing members that is adjustable in height; and an adjustable length bracket assembly, comprising:

a lower door mountable bracket with a lower door mounting portion and an upper fixture portion, the lower door mounting portion being shaped to fit around a bottom edge of a door; and an adjustable length member attached at one end to the upper fixture portion and at an other to the lower door mounting portion.

2. The easel of claim 1, wherein at least one of the plurality of workpiece securing members and tightening fixtures travel via a longitudinal slot disposed in longitudinal support member.

3. The easel of claim 2, wherein the tightening fixture is a threaded knob over a threaded bolt, the threaded bolt traveling through the slot.

4. The easel of claim 2, further comprising a door, the easel being attached thereto via the brackets.

5. The easel of claim 1, wherein the upper door mountable bracket is tension adjustable.

6. A door-mountable artist's easel, comprising:

an upper door mountable bracket with a door mounting portion and a fixture portion, the door mounting portion shaped to fit around a top edge of a door; and a workpiece attachment fixture, comprising:

a back frame, a top portion of the back frame being attached to the fixture portion of the bracket;

a vertically arranged, substantially longitudinal workpiece support member with an artist-side face, attached to a front side of the back frame, wherein the kength of the workpiece support member is approximately as long as a vertical length of the back frame;

first and second workpiece securing members, bounding a top edge and lower edge of a workpiece, and slidably attached to the artist-side face of the workpiece support member, wherein the first and second workpiece securing member are adjustable in height along the workpiece support member; and first and second tightening fixtures, fixing positions of the first and second workpiece securing members that are adjustable in height.

7. The easel of claim 6, further comprising at least one substantially lateral support member attached to the back frame.

8. The easel of claim 7, wherein the fixture portion of the bracket is attached to at least one of the substantially lateral support member.

9. The easel of claim 6, wherein at least one of the first and second workpiece securing members and tightening fixtures travel via a longitudinal slot disposed in the workpiece support member.

10. The easel of claim 6, wherein the tightening fixture is a threaded knob over a threaded bolt, the threaded bolt traveling through the slot.

11. The easel of claim 6, further comprising a door, the easel being attached thereto via the bracket.

12. The easel of claim 6, wherein the upper door mountable bracket is tension adjustable.

13. A door-mountable artist's easel, comprising:

an upper door mountable bracket with a door mounting portion and a frame attachment portion, the door mounting portion shaped to fit around a top edge of a door;

a back frame with a top portion and a bottom portion, a top portion of the back frame being attached to the frame attachment portion of the bracket;

a front frame with a top portion and a bottom portion, a top portion of the front frame being pivotally attached to another top portion of the back frame;

a rigidity guide pivotally attached to the back frame and pivotally attached to the front frame;

a vertically arranged, substantially longitudinal workpiece support member with a door-side face and an artist-side face, the door-side face being attached to the front frame;

a plurality of workpiece securing members, bounding a top and lower portion of a workpiece, and slidably attached to the artist-side face of the workpiece support member, wherein at least one of the plurality of workpiece securing members is adjustable in height along the workpiece support member; and at least one tightening fixture, fixing a position of at least one of the plurality of workpiece securing members that is adjustable in height.

14. The easel of claim 13, wherein the rigidity guide's pivot on the back frame travels through a groove in the back frame.

15. The easel of claim 14, further comprising a tightening knob disposed on at least one of the pivots of the rigidity guide.

16. The easel of claim 13, further comprising at least one substantially lateral support member attached to at least one of the front frame and back frame.

17. The easel of claim 13, wherein the at least one of the plurality of workpiece securing members and tightening fixtures travel via a longitudinal slot disposed in the workpiece support member.

18. The easel of claim 13, wherein the tightening fixture is a threaded knob over a threaded bolt, the threaded bolt traveling through the slot.

19. The easel of claim 13, further comprising a door, the easel being attached thereto via the brackets.

20. The easel of claim 13, wherein the upper door mountable bracket is tension adjustable.

* * * * *